US006041837A

United States Patent [19]

Hanson

[11] Patent Number: 6,041,837

[45] Date of Patent: Mar. 28, 2000

[54] FINGER JOINT JIG

[76] Inventor: Thomas William Hanson, 27698 Whirlaway Trl., Evergreen, Colo. 80439

[21] Appl. No.: 08/873,624

[22] Filed: Jun. 12, 1997

[51] Int. Cl.[7] ..... B27M 1/00

[52] U.S. Cl. ..... 144/371; 83/875; 144/82; 144/85; 144/90.1; 144/135.2; 144/253.1; 144/253.2; 144/253.5; 144/204.2; 269/304

[58] Field of Search ..... 83/431, 435.1, 83/432, 761, 743, 861, 875; 323/758, 759; 269/303–306, 315, 900; 144/82, 85, 90.1, 87, 133.1, 134.1, 135.2, 136.1, 203, 204.2, 253.1, 253.2, 253.5, 371, 372

[56] References Cited

U.S. PATENT DOCUMENTS

| | | | |
|---|---|---|---|
| 2,916,063 | 12/1959 | Boekenkamp | 144/204.2 |
| 2,972,366 | 2/1961 | Caruso | 144/204.2 |
| 3,606,916 | 9/1971 | Day | 144/204.2 |
| 4,655,455 | 4/1987 | Morse | 144/204.2 |

OTHER PUBLICATIONS

Woodsmith Shop catalog, Summer 1995, p. 18, "Aluminum Box Joint Jig," item #4502–658 and p. 19, photos of item #4502–658 and "Ready–to–assemble Box Joint Jig," item #7211–100.

*Primary Examiner*—W. Donald Bray
*Attorney, Agent, or Firm*—Thomas W. Hanson

[57] ABSTRACT

A jig for cutting a finger joint which eliminates the trial and error required to adjust the spacing between the key and the cutting blade. A key and an abutment are arranged on one side of the cutting blade. The key is connected to an alignment ledge on the opposite side of the cutting blade. The key, abutment, and alignment ledge can be aligned with the cutting blade so that the blade will trim all three when they pass over. When the cut is made, a gap is left which is the exact width of the blade. After the cut, the alignment ledge can be slide toward the abutment, closing the gap. The key, connected to the alignment ledge, moves a corresponding distance away from the blade. The key can then be fixed in position. A workpiece can then be placed flush against the trimmed face of the key and be cut, leaving a finger, between the key and the blade, which is the exact width of the adjacent kerf, formed by the blade.

16 Claims, 10 Drawing Sheets

FINGER JOINT JIG

FIELD OF INVENTION

The invention relates generally to making finger joints in wood and particularly to making finger joints using a table saw or router.

BACKGROUND

The finger joint is a common joining technique used in woodworking to join two boards together, often at right angles. Its most common application is in the making of boxes. For this reason, the finger joint is sometimes referred to as a "box joint."

In a finger joint, the ends of both boards are cut to form a series of fingers separated by spaces, or "kerfs." The boards are joined by interlocking the fingers of one board with the fingers of the other board and using an adhesive to maintain the joint. The key to a good finger joint is that the width of the fingers and the width of the kerfs be identical, providing a tight fit when the fingers are inserted into the kerfs.

Outside of a production shop, finger joints are most often cut using either a router or a table saw. The router approach typically uses a template to guide the router. The template will have a separate slot for each kerf to be cut. the width of the finger is controlled by the spacing of the template and the width of the kerf is dictated by the width of the router bit. The table saw approach typically uses a fixture, or jig, to hold the board in position, on end, as it is passed over the table saw blade. After each pass the board is moved to a new position in the jig, often aligning the most recently cut kerf with a key to align the board for the next cut. The width of the fingers is controlled by the distance between the key and the blade and the width of the kerf is determined by the thickness of the blade. Dado blades are often used to provide wider cuts.

The traditional approach to using a jig to cut finger joints on a table is described in Finger Joints, Woodsmith, v. 19, #110, April 1997 (Woodsmith). The starting point for the jig is a fence, perpendicular to both the table and the blade which is fixed in position laterally relative to the blade but free to slide in the direction of the cut. This is usually accomplished by fixing a board to the table saw's miter gauge and setting the gauge for a 90 degree cut. The fence may be supplemented with a ledge, attached to the bottom of the fence, parallel to the table. The ledge supports the board being cut and provides support for the key. With the fence in place, the steps for setting up the jig are: 1) adjust the blade to the thickness of the stock; 2) cut a notch in the fence, and ledge; 3) make a key, sized to fit tightly in the notch and glue it in place; 4) using a spacer the same size as the key, adjust the fence so that the space between the blade and the key is the width of the spacer (and thus the key); 5) test the jig and make adjustments to the key location and blade height until a tight joint is achieved; 6) fix the fence in position with screws and/or glue.

In the above process, steps 3 and 5 are critical to the setup of the jig and can be very time consuming. The key used in step 3 is quite small, often one to one and one half inches long and the thickness of the blade being used, often one eighth to one quarter inch. Because of this, it must be shaped by hand and must be an exact match for the width of the blade. Inaccuracies in the key may result in a loose fit in the notch and make the adjustments in step 5 more difficult.

Step 5 is the final adjustment of the jig. A test joint is made by cutting two boards and fitting them together. If the joint is loose, the key (and fence) must be adjusted to move away from the blade. If the joint is tight, the key must be moved toward the blade. After the adjustment, a new test joint is cut, and the process is repeated. The adjustments in the key position may be in increments of 1/64ths of an inch (or less) and several iterations may be required before a tight joint is achieved.

Finger joint jigs are also available commercially. One example is the "Aluminum Box Joint Jig" available from Woodsmith Shop (Summer 1995 catalog, pg. 18). This jig provides a fence and ledge as described above but also provides a built-in adjustable key to alleviate the problems associated with step 3 above. It also provides a threaded adjuster for setting the gap between the key and the blade. However, the basic approach is as described above, and iteration is still required in step 5 to obtain a good joint.

Once the jig is properly set, a large number of high quality joints can be cut it relatively short time. However, the trial and error approach to setting the jig can result in a high level of frustration for the woodworker. Where a single box is being made, the set-up time can easily exceed the time needed to actually cut the joint. Because of this, the finger joint may be avoided by amateur woodworkers and even professionals who work in very small quantity.

There is need for a finger joint jig which eliminates the trial and error setup described above and which preferably does not require the hand fitting of the key piece to the slot cut by the blade.

SUMMARY OF THE INVENTION

The present invention is of a finger joint jig for use with a cutting device, such as a table saw or router table, which addresses the above, and other, needs. In the preferred embodiment, the jig comprises a support structure; a means for attaching the support structure to the cutting device whereby said support structure is free to move in one dimension, passing over the cutting blade, or bit; a key; an abutment means fixed to the support structure; an alignment means slidably attached to the support structure; a means for attaching the key to the alignment means; a means for fixing the key and the alignment means in position relative to the support structure and a means for adjusting the position of the key, the abutment means, and the alignment means relative to the cutting device whereby when the jig passes over the cutting means, a first side of the cutting means will trim the key means and the abutment means in the same plane and the opposite side of the cutting means will trim the facing surface of the alignment means.

In a further embodiment of the invention, the key, abutment means, and alignment means are formed as a single unit which is removably attached to the support structure, and can be replaced for each new finger joint setup.

In a still further embodiment of the invention, the support structure includes a fixed vertical panel which extends above the height of the cutting blade, or bit, and the means for attaching the key to the alignment means is a sliding vertical panel which also extends above the height of the cutting blade.

Also disclosed is a method of forming a finger joint using the disclosed jig.

DESCRIPTION OF THE PREFERRED EMBODIMENT

Figure 1:
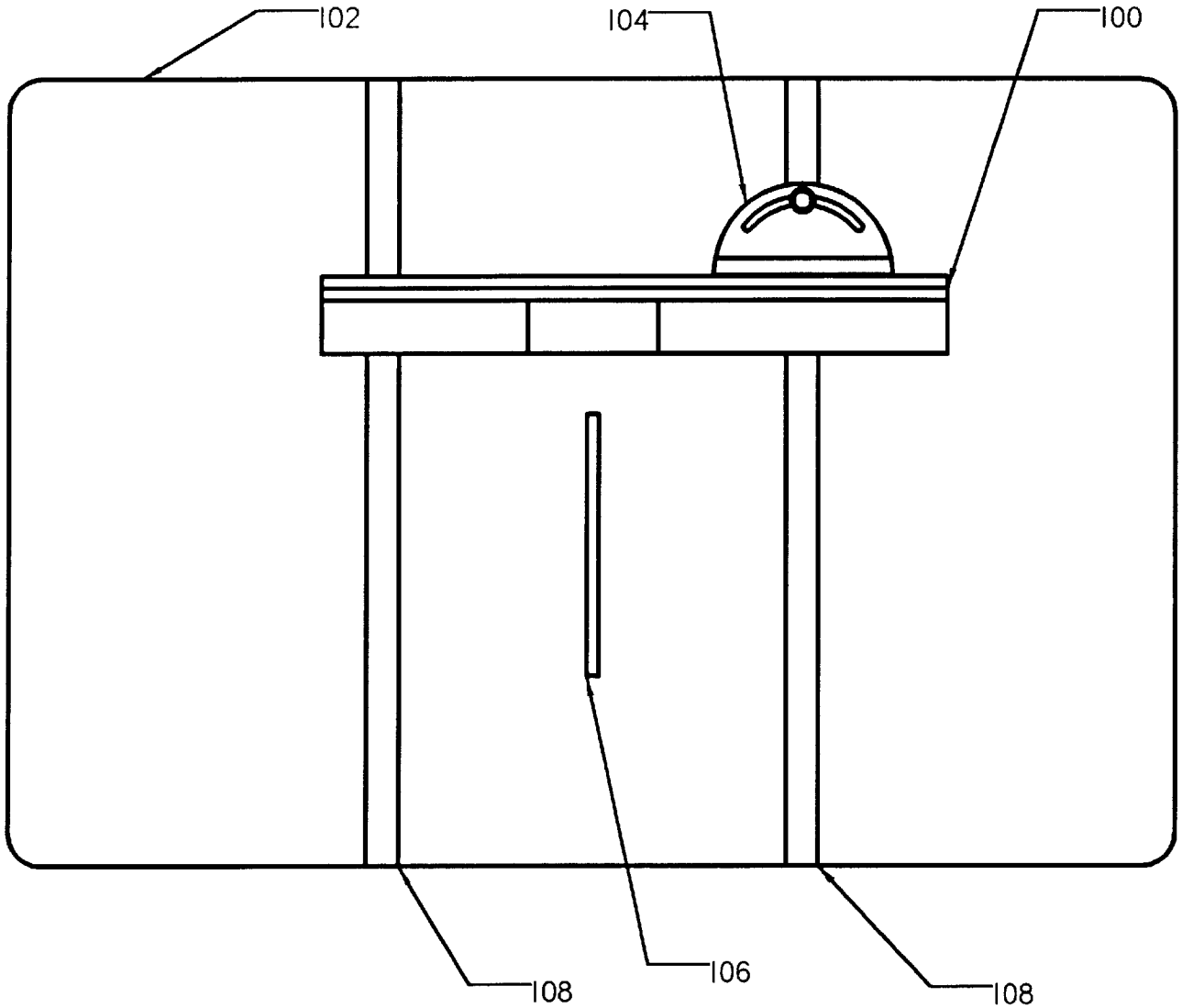
FIG. 1 provides a top view of the jig in place on a table saw.

The following description is of the best presently contemplated modes of carrying out the present invention. This description is not to be taken in a limiting sense but is made merely for the purpose of describing the general principles of the invention. The scope of the invention should be determined by referencing the appended claims.

The device of the present invention is generally applicable to the forming of finger joints to join together boards. This joint is commonly used to form either right-angle joints, as in making a box, or an end-to-end joint. Joining at other angles is also possible. While the preferred embodiment uses a table saw as the cutting means, other alternatives, such a router are anticipated.

The following is a brief glossary of terms used herein. The supplied definitions are applicable throughout this specification and the claims unless the term is clearly used in another manner.

Abutment—fixed portion of the jig which is trimmed by one side of the cutting means and against which the alignment portion will abut during set up. In the preferred embodiment this is the lower left portion of the ledge.

Alignment stop—movable portion of the jig which is trimmed by the opposite side of the cutting means as the abutment and which is moved to be flush against the abutment during set up. In the preferred embodiment this is the right side of the ledge.

Backplane—refers to the back, vertical portion of the jig consisting of one or more layers.

Replaceable section—refers to that portion of the jig which is cut by the blade. In the preferred embodiment, this portion is replaceable so that a different piece may be used for each joint or each width of cut. In the alternative, the entire jig can be re-built for each joint.

Front, Back—as used in reference to the jig, when the jig is in use, the front side is away from the user and toward the table saw blade and the back side is toward the user and away from the blade.

Kerf—refers to the slot cut by the saw blade, specifically the gap between the fingers of the finger joint which is cut by the blade or the clot cut in the jig during set up.

Key—that portion of the jig against which the workpiece is aligned.

Lateral—describes movement parallel to the surface of the saw table and along the length of the jig. In a typical configuration this is at right angles to the blade Ledge—the horizontal portion of the jig extending outward from the backplane, parallel to the table of the table saw.

Left, Right—unless clearly used otherwise, left and right are relative to a front view of the jig from the blade position looking back towards the user. Note that the jig is also fully functional as a mirror image, where all left and right references would be reversed.

Support Structure—structural components of the jig, those sections which support the workpiece, hold the other parts in place, and slidably attach to the table saw. In the preferred embodiment this includes the backplane and portions of the ledge.

The various drawing figures disclose the present invention in detail showing the preferred embodiment, and alternative embodiments. The following discussion is with reference to these figures.

FIG. 1 shows the jig, 100, in position on a table saw, 102. The jig is attached to a conventional miter gauge, 104, which is set for a 90 degree cut. The miter gauge rides in one of the slots, 108, in the saw table. Either slot could be used, with the position of the jig relative to the gauge being adjusted accordingly. Alternatively, the jig could be attached directly to either one, or two, rails which ride directly in the table saw slots. Permanent attachment to two rails, riding in both slots, provides increased accuracy and ease of use. Either of the above alternatives results in the jig being fixed in position laterally relative to the blade, 106, while able to slide over the blade in the direction of the cut. While normally used as shown for a 90 degree cut, it would also be possible to alter the angle to form a more complex joint.

Figure 2:
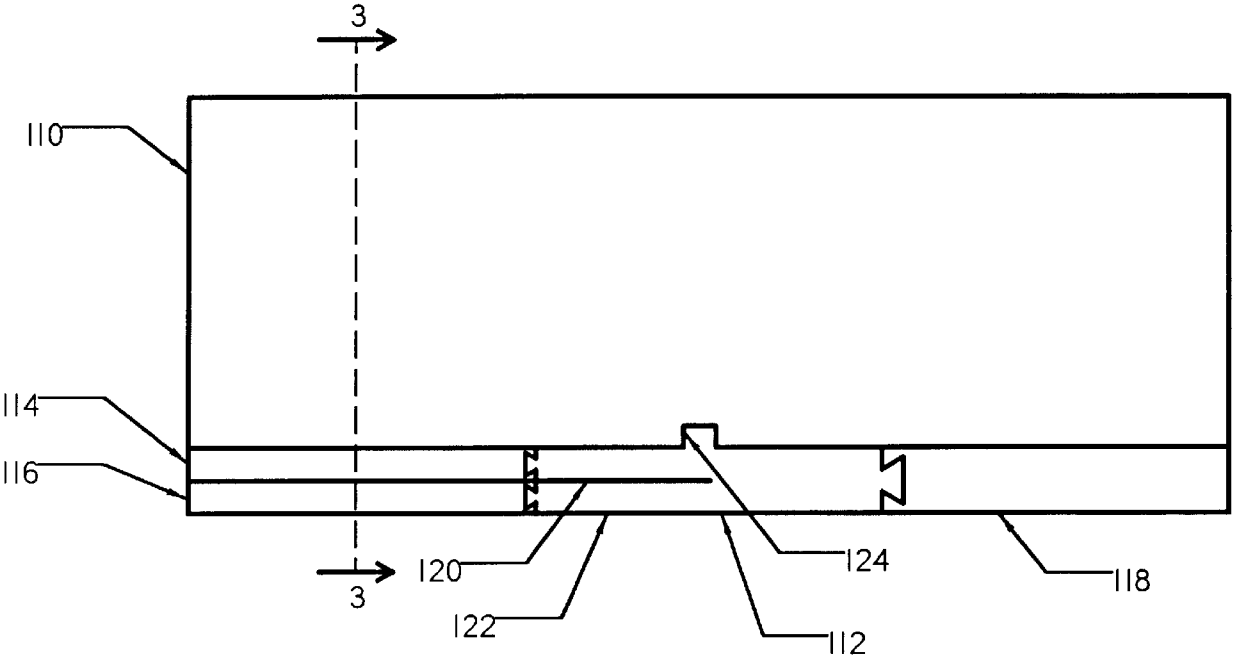
FIG. 2 provides a front view of the jig.
Figure 20:
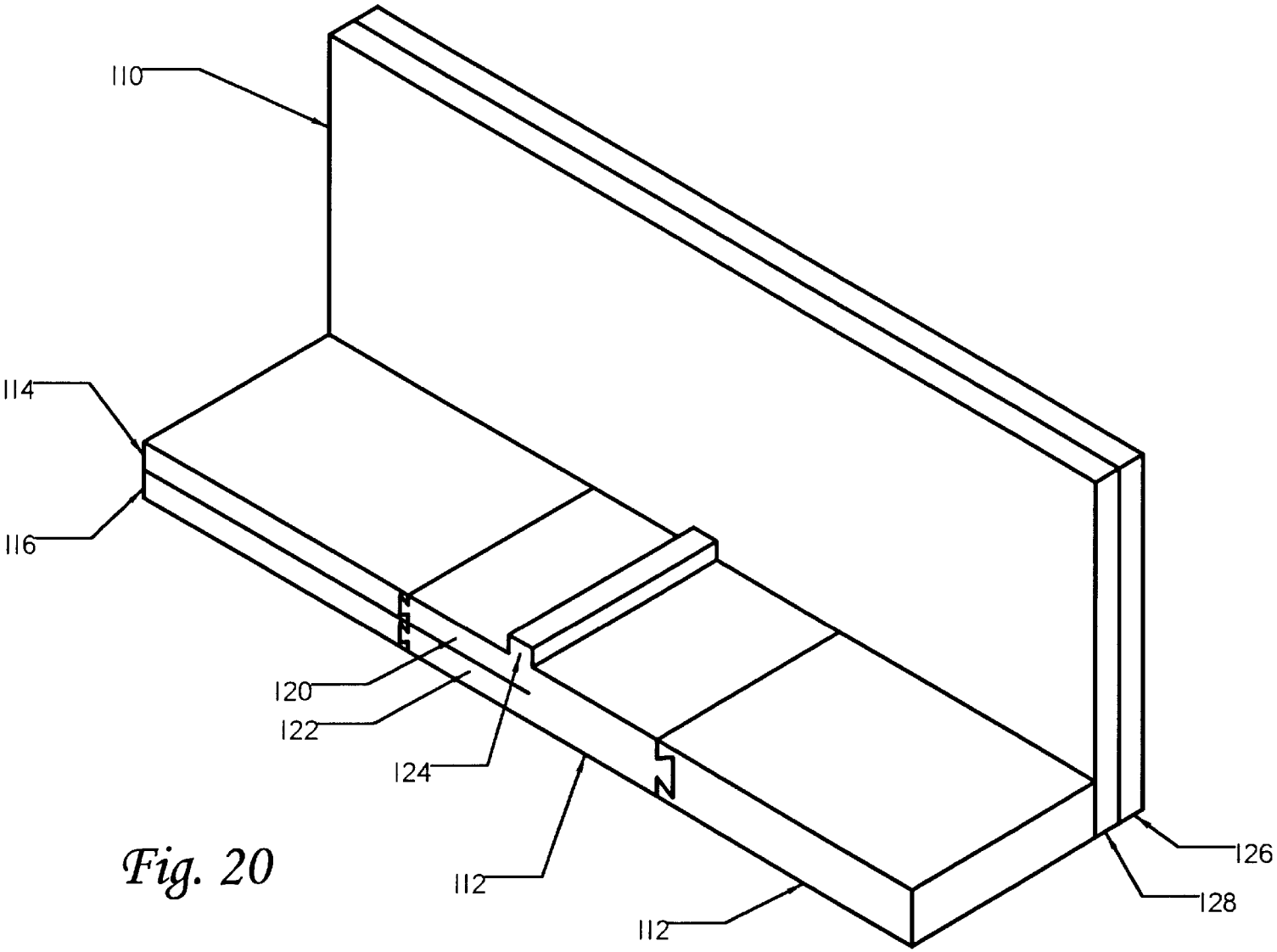
FIG. 20 provides an isometric view of the invention.

FIG. 2 shows the preferred embodiment of the invention from the front side, looking from the blade of the table saw back toward the user. The backplane, 110, provides a vertical support for the workpiece as well as providing a significant portion of the support structure. The lower portion of the jig is a ledge, parallel to the table of the table saw, which comprises several sections. On the right side the ledge is a single piece, 118, which is a permanent part of the structure. On the left side, the ledge is bifurcated into upper, 114, and lower, 116, portions which are also permanent. The center of the ledge, 112, is replaceable, being consumed each time a new joint configuration is set up. The replaceable section, 112, will be made of an easily formed material which can be cut by the saw blade without excessive wear. Injection molded plastic is a good candidate. The replaceable section attaches to the permanent portions of the ledge at both ends. Many means of attachment could be used including a dovetail, as shown, a clamping mechanism, adhesive, and others. These elements are also shown in FIG. 20 from a perspective view.

The replaceable portion, 112, is also bifurcated on the left side into upper, 120, and lower, 122, portions. These attach to the upper, 114, and lower, 116, portions of the ledge, respectively. The upper portion, in combination with section 114, serves the role of a support ledge, supporting that portion of the workpiece to the left of the key. The lower portion serves the role of an abutment, remaining in position and serving as a stop for the right side when the adjustment is made. The key, 124, protrudes above the upper portion of the ledge and is positioned above the bifurcated portion of the replaceable section. The right side of the replaceable portion, in combination with section 118, serves the role of the alignment stop.

In an alternative embodiment, the support ledge could be a single piece, rather man composed of a permanent and a replaceable section. The same is true of the abutment and the alignment stop. In the following description support ledge, abutment, and alignment stop will be understood to include both the corresponding permanent and replaceable sections of the jig, unless clearly used otherwise. This use is intended to encompass alternative embodiments in which one or more of these sections is constructed as a single unit.

Figure 3:
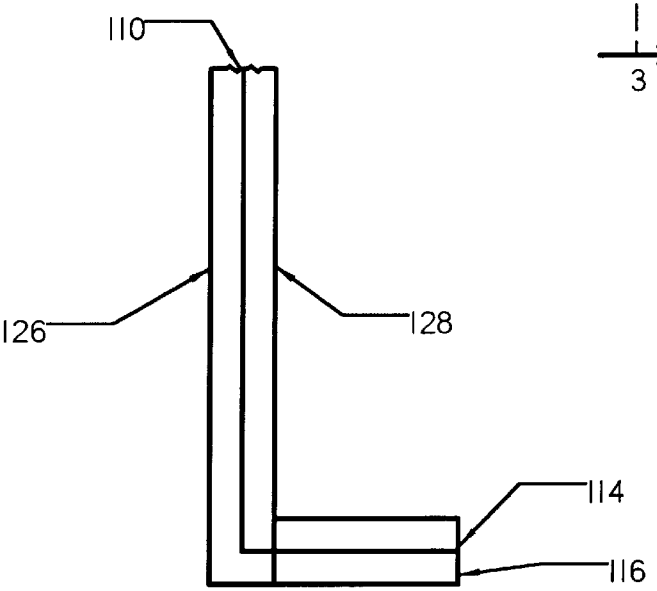
FIG. 3 shows a cross-section of the jig through the backplane and the ledge

FIG. 3 shows a cross section through the permanent portion of the jig. As this view shows, the backplane, 110, comprises two separate planes which can slide laterally relative to each other. The rear plane, 126, is attached to the abutment, 116, and is fixed in position laterally, after the initial set up. In use, the rear plane and the abutment remain fixed in position, laterally, relative to the saw blade. The front plane, 128, is attached to the support ledge, 114, and is also attached to alignment stop, 118. These three pieces are fixed in relation to each other, but can move laterally relative to the rear plane, and the saw blade. When the replaceable section, 112, is initially installed, it is a single piece and fixes all of the sections of the jig in position relative to each other.

Figure 4:
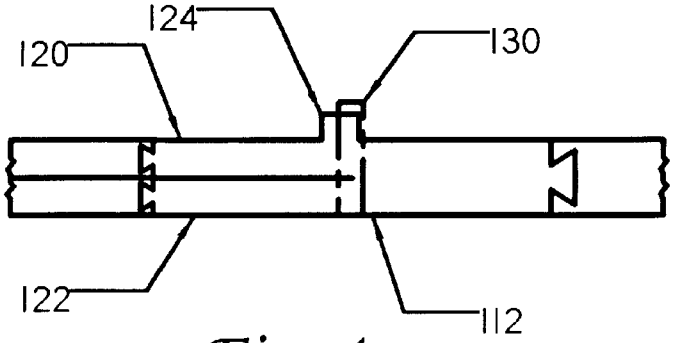
FIG. 4 provides a detailed view of the central portion of the jig prior to the first cut being made.
Figure 21:
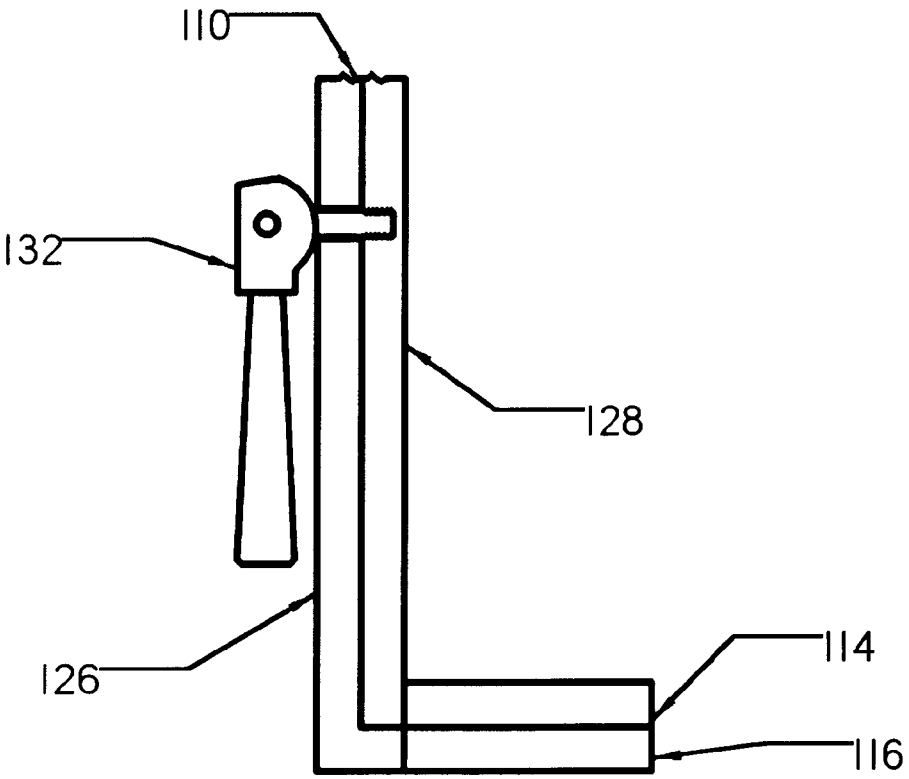
FIG. 21 illustrates an optional clamping mechanism via a cross section at the same location as FIG. 3.

FIGS. 4 through 8 illustrate the set up steps for the jig. FIG. 4 shows a detailed view of the replaceable section, 112, of the jig and part of the permanent portions of the ledge. Area 130 shows the area which will be removed by the saw blade as the cut is made. For the jig to work properly, the cut must intersect the bifurcated portion of the replaceable section. The cut must also be flush with the right edge of, or preferably, remove part of the key, 124. The initial set up of the jig will align the rear plane and the key to establish this relationship. This can be achieved either by shifting the position of the support structure relative to the miter guage or by an additional adjustment which allows the abutment to be shifted laterally relative to the support structure. Prior to the cut, the two planes of the backplane will be fixed together to prevent movement during the cut, preferably by clamping, such as with a cam handle, 132, as shown in FIG. 21, or by means of a set screw. When the cut is made, the blade will pass completely through the replaceable section, from front to rear, as well as a small section of the backplane.

Figure 5:
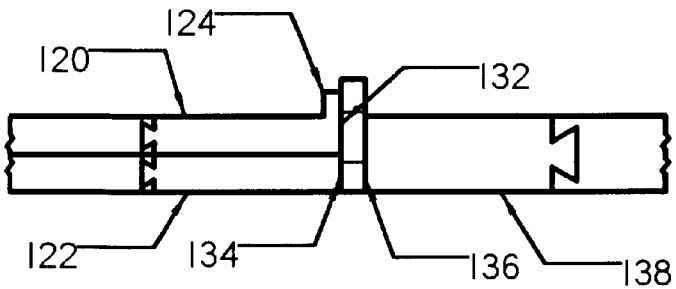
FIG. 5 shows the central portion of the jig after the first cut, prior to the adjustment.

FIG. 5 shows the same view after the cut has been made. The results of the cut are three-fold, first, the abutment, 122, is separated from the rest of the replaceable section. This will allow the two planes of the back plane, and their attached sections of the ledge, to move laterally once unclamped. Secondly, the cut face, 134, of the abutment and the cut face, 132, of the support ledge, 120, and key, 124, are in exact alignment, having been cut by the same edge of the blade. Thirdly, the gap between cut face 134 and the cut face 136, of the alignment stop, 138, is the exact width of the blade and the kerf which it makes. The alignment of faces 132 and 134 and the gap between face 134 and face 136 are what result in the correct alignment of the jig.

Figure 6:
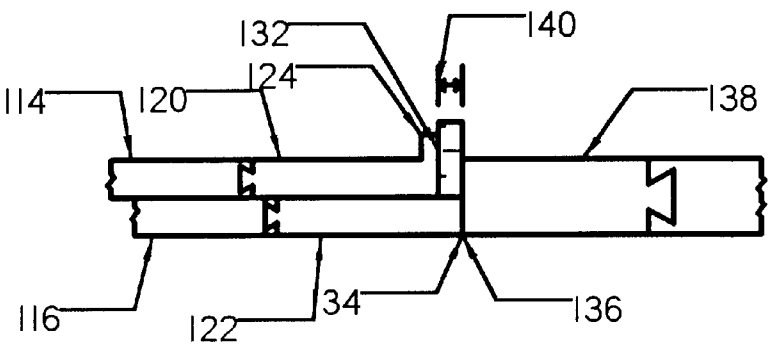
FIG. 6 shows the central portion of the jig after the key has been shifted to the left by the width of the cut.

FIG. 6 shows the jig after being aligned. The abutment, 122, remains fixed in place. The alignment is achieved by unclamping the two planes of the backplane allowing the front plane, 128, to slide laterally. As discussed above, the support ledge, 120, and key, 124, are attached to the front plane of the backplane. Similarly, the alignment stop, 138, is attached to the front plane. As a result of this interconnection, the front plane, support ledge, key, and alignment stop will move in unison as they are slid laterally. These sections are slid laterally to the left until face 136 of the alignment stop is flush against face 134 of the abutment and they are again clamped to the rear plane to fix them in position relative to the saw blade. The distance moved is exactly the width of the kerf. The effect of this is to shift the key, 124, to the left by the exact width of the kerf, leaving a gap, 140, between the right face of the key, and the left edge of the blade (which is aligned with face 134) which is exactly the width of the kerf. When the workpiece is cut, this gap corresponds to the thickness of the finger portion of the joint. The overall result is a finger which is the exact width of the kerf, with no fine tuning required. The height of the blade will still have to be adjusted for the thickness of the workpiece.

Figure 7:
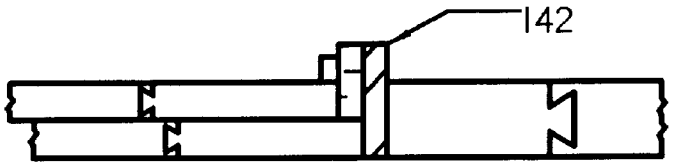
FIG. 7 shows the central portion of the jig after the second, and subsequent, cuts are made.

As FIG. 7 shows, subsequent passes of the saw blade will again cut through the replaceable portion of the jig, removing section 142. This is why the sections of the jig must be fixed in place relative to each other prior making subsequent cuts. This can be achieved by again clamping together the front and read planes of the backplane, as described above. Alternatively, the bifurcated portions of the replaceable section can be glued together. This results in a more stable alignment suitable for long-term use.

Figure 8:
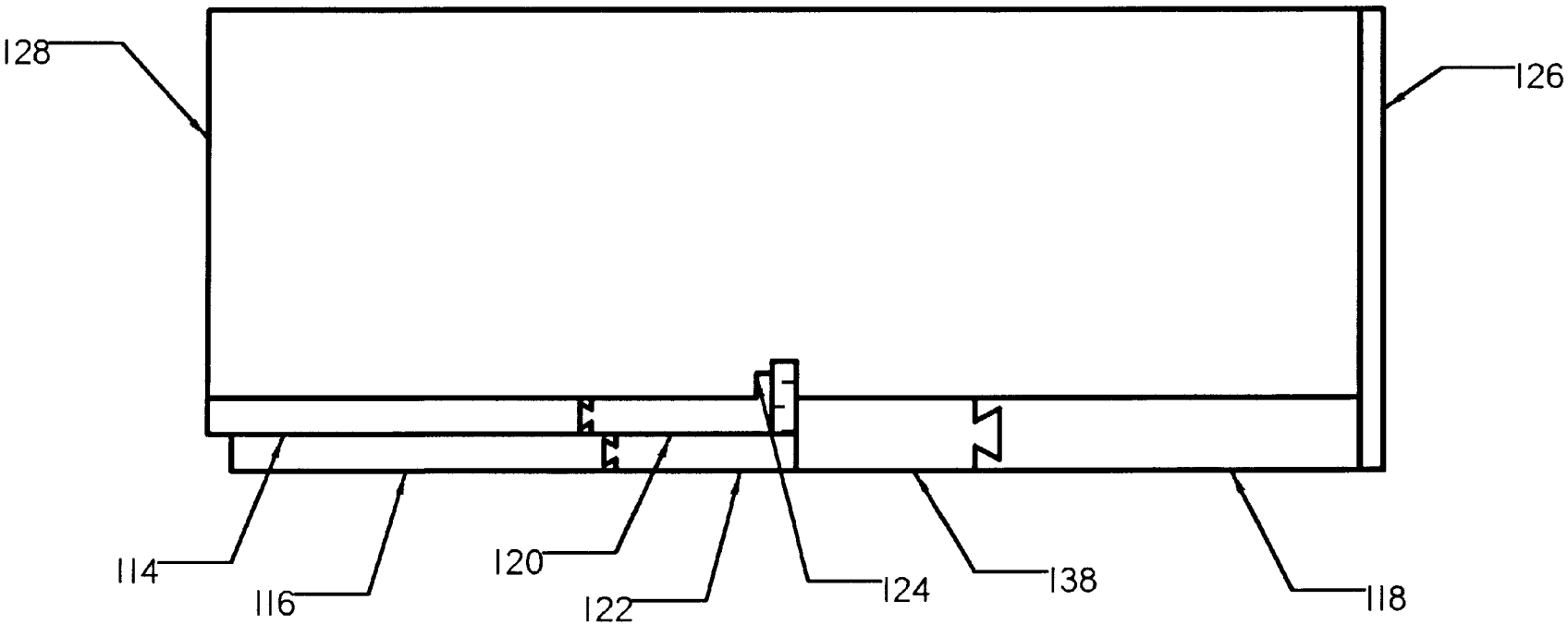
FIG. 8 shows the entire jig at the same point as FIG. 5, after the adjustment FIG. 9 provides a detailed view of the workpiece in position to cut the first kerf after the jig is set up.

FIG. 8 shows the overall jig at the same point as the detailed view of FIG. 5. The front plane, 128, alignment stop, 138 and 118, and the support ledge, 114 and 120 have been shifted to the left, offsetting the key, 124. The rear plane, 126, and the abutment, 116 and 122, have remained in position relative to the saw blade.

Figure 11:
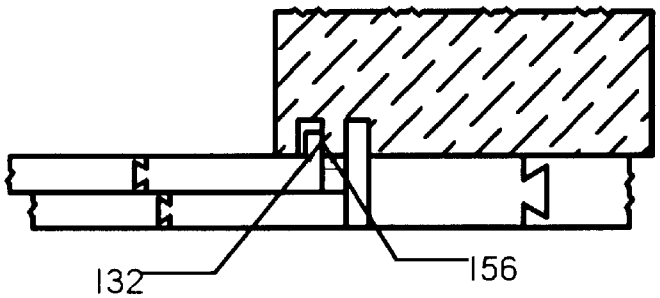
FIG. 11 shows the workpiece after the second kerf has been cut
Figure 9:
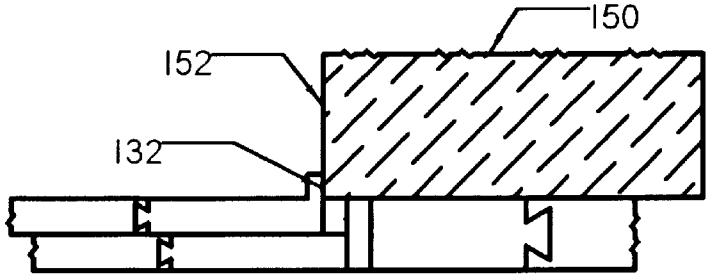
Figure 10:
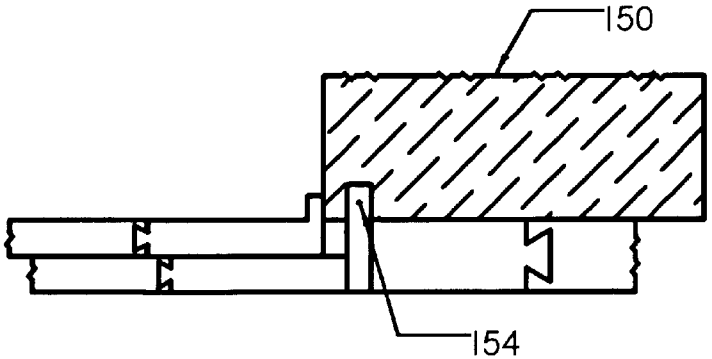
FIG. 10 shows the workpiece after the first kerf has been cut.

FIGS. 9 through 11 show the jig in use cutting a finger joint in a workpiece. In FIG. 9 the workpiece, 150, is shown positioned for the initial cut. The end of the workpiece is placed against the ledge and one edge, 152, is placed flush against the face, 132, of the key. FIG. 10 shows the workpiece after the first cut is made, forming kerf 154.

FIG. 11 shows the workpiece after the second kerf is cut. To make the second, and subsequent cuts, the workpiece is shifted so that the left face, 156, of the previous kerf is flush against the right face, 132, of the key. Unlike the traditional approach, the key will not typically be the exact width of the kerf. It does not thus serve to hold the workpiece in position laterally and the workpiece must be held in position against the key either by the operator or by clamping or spring means attached to the jig. If desired, the jig can be positioned during set up such that the initial cut will trim the key to the exact width of the kerf. Alternatively, the key portion can be formed with a resilient core, or an imbedded spring, so that the left face of the key will be urged outwardly, urging the workpiece to the left, holding it in contact with the right face of the key.

Figure 12:
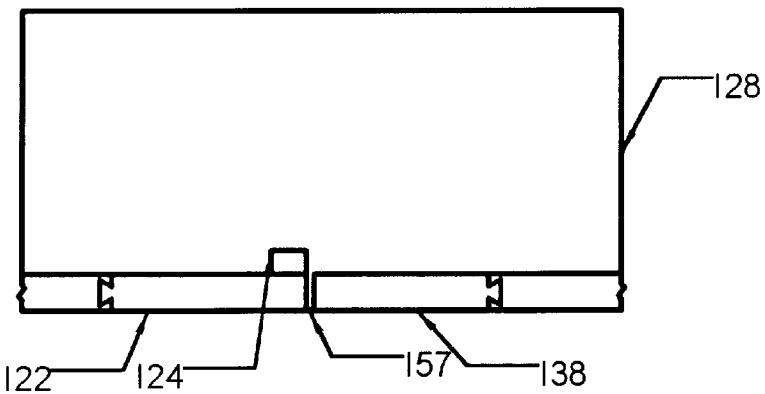
FIG. 12 shows a detailed view of an alternative embodiment which is a minimal configuration of the invention.

FIG. 12 shows an alternative, minimal, embodiment of the invention. The support ledge, 114 and 120, has been eliminated. The key, 124, attaches directly to the front plane, 128, of the backplane which in turn connects to the alignment stop, 138. Gap, 157, can occur between the abutment, 122, and the alignment stop, as long as it is narrower than the kerf cut by the blade. This embodiment functions in the same manner as the preferred embodiment, with the key sliding to the left after the initial cut. This approach is weaker than the preferred embodiment in that the key is not supported by support ledge. However, given a sufficiently strong material, or for light use, this design may be adequate.

Figure 13:
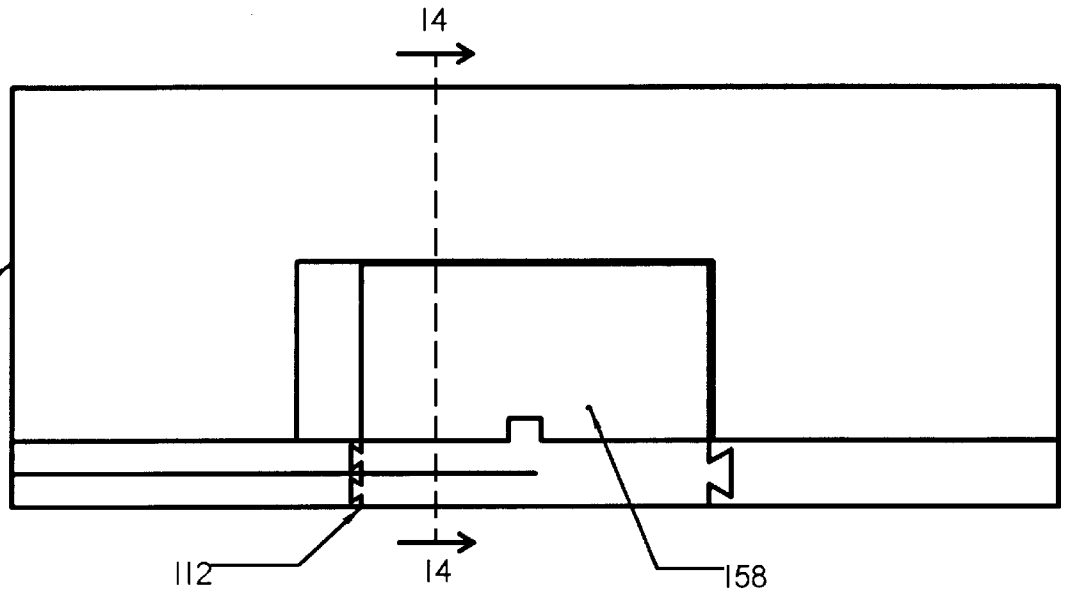
FIG. 13 shows another alternative embodiment of the invention wherein a portion of the backplane is formed as part of the replaceable portion of the ledge.
Figure 15:
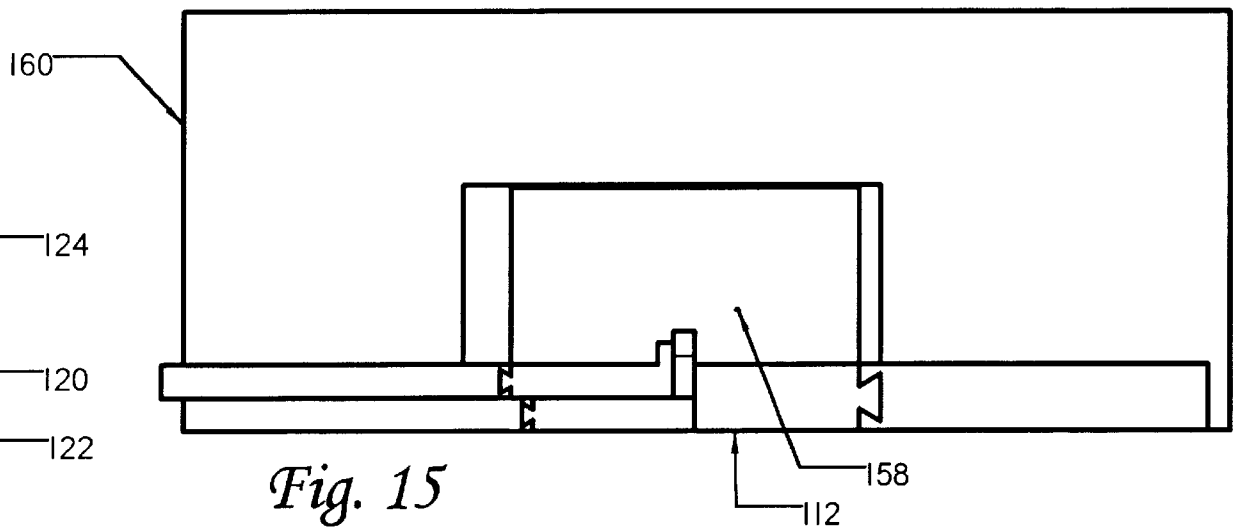
FIG. 15 illustrates the alternative embodiment of FIG. 13 after the adjustment.
Figure 14:
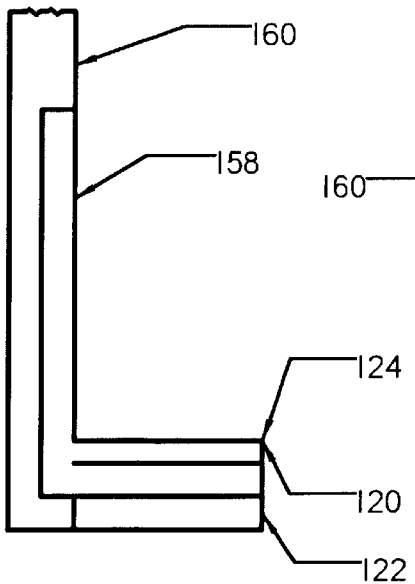
FIG. 14 provides a cross section of the alternative embodiment of FIG. 13.

FIGS. 13 through 15 illustrate another alternative embodiment of the invention. As discussed above, the cuts which form the kerfs in the workpiece also cut through the backplane of the jig. This may be undesirable for long term use and requires that the backplane be made of material which will not damage the saw blade. As shown in FIG. 13, the replaceable section, 112, includes a vertical portion, 158, which serves as the front plane of the backplane. In this embodiment, it is inset into the rear plane. As the cross-section of FIG. 14 shows, the front plane, 158, the key, 124, the support ledge, 120, and the abutment, 122 are formed as a single piece with a slight separation between the upper and lower portions. This approach has the further advantage that the permanent portion of the backplane can be formed as a single piece. As FIG 15 shows, the operation of the jig is similar to the preferred embodiment with the moveable portions of the replaceable section, 112, complete with front plane, 158, sliding within the rear plane, and the ledge moving as before.

Figure 17:
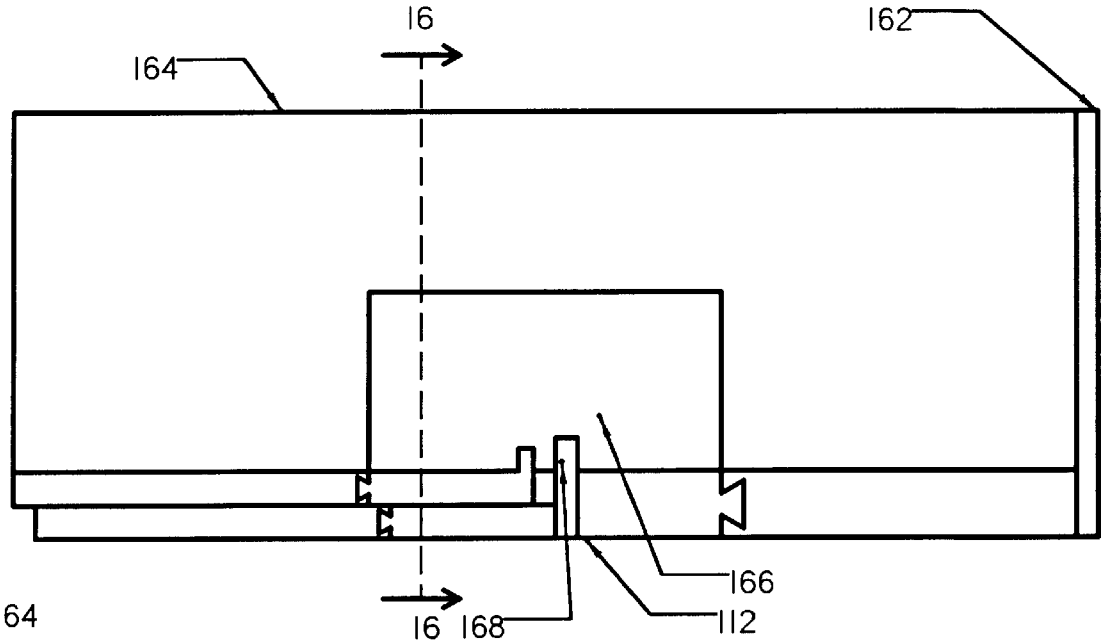
Figure 16:
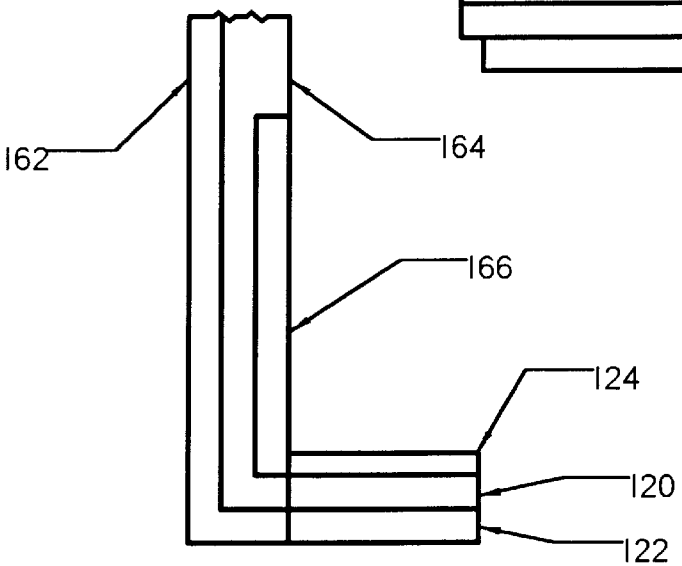
FIG. 16 shows a cross section through another alternative embodiment of the invention FIG. 17 provides a front view of the alternative embodiment of FIG. 16

FIG. 16 shows another alternative embodiment of the invention in which the back plane is composed of three layers. The rear plane, 162, and front plane, 164, function as described for the preferred embodiment, above. The backing panel, 166, is removable. During set up of the jig, the backing panel is removed so that it will not be cut by the blade. After set up and before the first kerf is cut in the workpiece, the backing panel is inserted behind the key, 124, and optionally behind a portion of the ledge. As FIG. 17 shows, when the cut is made, the gap, 168, in the backing panel is exactly aligned with the kerf being cut in the workpiece. This allows the backing panel to support the edges of the kerf, minimizing splinters and tear-out in the workpiece at the edges of the kerf.

Figure 18:
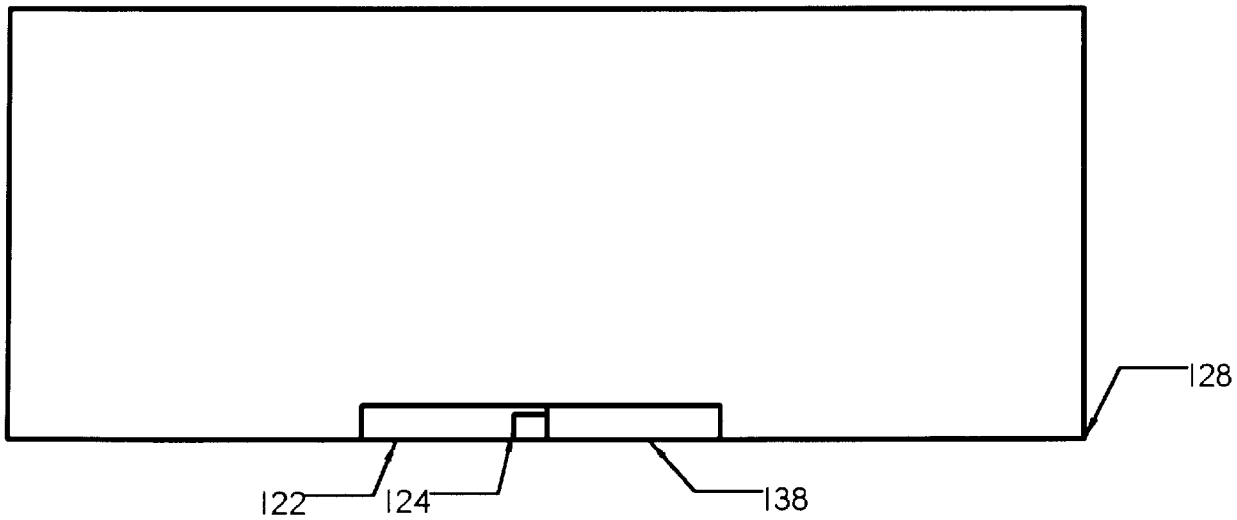
FIG. 18 shows a front view of another alternative embodiment in which the key is placed n front of the abutment.
Figure 19:
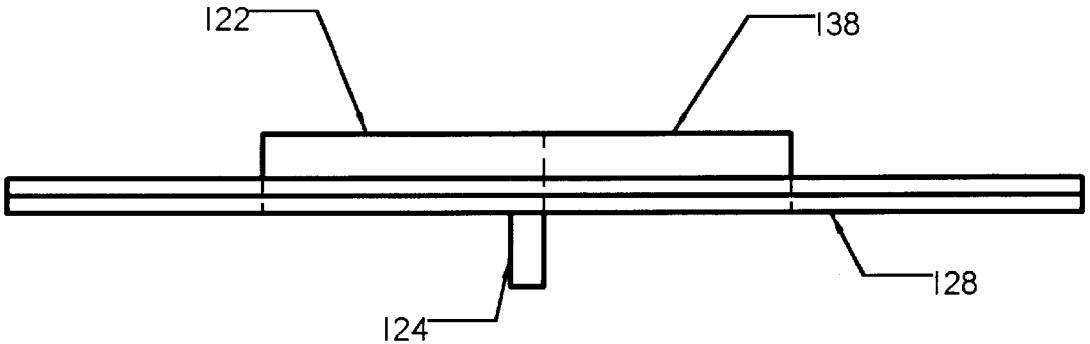
FIG. 19 provides a top view of the alternative embodiment of FIG. 18.

FIGS. 18 and 19 illustrate another alternative embodiment of the invention. In this configuration the left, abutment, 122, the alignment stop, and the key, 124, are all positioned in contact with the surface of the table saw. As the top view of FIG. 19 shows, the key, 124, is positioned in front of the abutment, 122. The saw blade passes sequentially through the key and then the abutment, trimming them in the same plane. Otherwise, this embodiment functions as described for the preferred embodiment.

While the preferred form of the invention and some alternative embodiments, have been disclosed above, further alternative methods of practicing the invention are readily apparent to the skilled practitioner. The above description of the preferred embodiment is intended to be illustrative only and not to limit the scope of the invention.

I claim:

1. A finger joint jig for use with a cutting device comprising a flat table and cutting means having two opposite sides, said jig comprising:

(a) a support structure;

(b) a means for attaching said support structure to the cutting device whereby said support structure is free to move in one dimension relative to the cutting device and said one dimension of movement allows said support structure to pass over the cutting means;

(c) an abutment attached to said support structure whereby when said support structure passes over the cutting means, a first side of the cutting means will trim a face of said abutment;

(d) alignment means slidably attached to said support structure;

(e) a key;

(f) key attachment means connecting said key to said alignment means;

(g) locking means for fixing said key and said alignment means in position relative to said support structure whereby when said support structure passes over the cutting means, a first side of the cutting means will trim a face of said key in the same plane as said face of said abutment and the second, opposite side of the cutting means will trim a face of said alignment means.

2. The finger joint jig of claim 1 wherein the cutting means is a saw blade.

3. The finger joint jig of claim 2 wherein said saw blade is a dado blade.

4. The finger joint jig of claim 1 wherein the cutting means is a router bit.

5. The finger joint jig of claim 1 wherein said key, said alignment means, and said abutment are formed as a one piece unit.

6. The finger joint jig of claim 1 wherein said support structure comprises a fixed vertical panel adapted to extend above the cutting height of the cutting means.

7. The finger joint jig of claim 6 further comprising a vertical backing panel removably attached to said fixed vertical panel.

8. The finger joint jig of claim 1 wherein said key attachment means is sliding vertical panel adapted to extend above the cutting height of the cutting means.

9. The finger joint jig of claim 1 further comprising a support ledge connected to said key, said support ledge having a top surface, said alignment means having a top surface, wherein said support ledge top surface is in substantially the same plane as said alignment means top surface.

10. The finger joint jig of claim 9 wherein said key, said support ledge, said abutment, and said alignment means are formed as a one piece unit.

11. The finger joint jig of claim 10 wherein said one piece unit is removably attached to said support structure.

12. The finger joint jig of claim 1 wherein after said key is trimmed, the width of said key is less than the width of the cutting means.

13. The finger joint jig of claim 1 further comprising a means for adjusting the position of said abutment relative to the cutting device.

14. The finger joint jig of claim 1 further comprising means for adjusting the position of said key and said alignment means in the direction of said slidable attachment.

15. A finger joint jig for use with a cutting device comprising a flat table and cutting means having two opposite sides, said jig comprising:

(a) a support structure comprising a fixed vertical panel adapted to extend above the cutting height of the cutting means;

(b) means for attaching said support structure to the cutting device whereby said support structure is free to move in one dimension relative to the cutting device and said one dimension of movement allows said support structure to pass over the cutting means;

(c) an abutment fixed to said support structure;

(d) a key;

(e) an alignment stop, having a top surface, slidably attached to said support structure;

(f) a support ledge, having a top surface, connected to said key, said support ledge top surface in substantially the same plane as said alignment stop top surface;

(g) a sliding vertical panel adapted to extend above the cutting height of the cutting means, connecting said key, said support ledge, and said alignment stop;

(h) locking means for fixing said alignment stop in position relative to said support structure and (i) means for adjusting the position of said key, said abutment, and said alignment stop relative to said support structure whereby when said support structure passes over the cutting means, a first side of the cutting means will trim said key and said abutment in the same plane and the second, opposite side of the cutting means will trim said alignment stop;

wherein said key, said alignment stop, said abutment said support ledge, and said sliding vertical panel are formed as a one piece unit and said one piece unit is removably attached to said support structure.

16. A method of forming the kerfs and fingers of a finger joint in a workpiece comprising:

(a) providing a cutting device comprising a flat table and cutting means having two opposite sides;

(b) providing a finger joint jig comprising:

(i) a support structure comprising a fixed vertical panel adapted to extend above the cutting height of the cutting means;

(ii) means for attaching said support structure to the cutting device whereby said support structure is free to move in one dimension relative to the cutting device and said one dimension of movement allows said support structure to pass over the cutting means;

(iii) an abutment fixed to said support structure;

(iv) a key;

(v) alignment means, having a top surface, slidably attached to said support structure;

(vi) a support ledge, having a top surface, connected to said key, said support ledge top surface in substantially the same plane as said alignment means top surface, (vii) a sliding vertical panel adapted to extend above the cutting height of the cutting means, connecting said key, said support ledge, and said alignment means;

(viii) locking means for fixing said alignment means in position relative to said support structure ad (ix) means for adjusting the position of said key, said abutment, and said alignment means relative to said support structure;

(c) adjusting the position of said key, said abutment, and said alignment means whereby when said support structure passes over the cutting means, a first side of the cutting means will trim said key and said abutment in the same plane and the opposite side of the cutting means will trim said alignment means;

(d) passing said finger joint jig over the cutting means whereby said key, said abutment, and said alignment means are trimmed, leaving a gap with width equal to the width of the cutting means;

(e) adjusting said alignment means flush against said abutment whereby said key is offset by the width of said gap;

(f) placing the workpiece on said finger joint jig, resting on said alignment means top surface, with a first edge of said workpiece flush against the trimmed face of said key;

(g) passing said finger joint jig and said workpiece over the cutting means whereby said cutting means cuts a kerf in said workpiece;

(h) repositioning the workpiece with a face of the kerf flush against said trimmed face of said key; and (i) repeating steps (g) and (h) until the desired number of kerfs has been created.

* * * * *